US009009970B2

(12) United States Patent
Higai et al.

(10) Patent No.: US 9,009,970 B2
(45) Date of Patent: Apr. 21, 2015

(54) CURVILINEAL CLOSED STRUCTURE PARTS AND METHOD FOR MANUFACTURING THE SAME

(75) Inventors: Kazuhiko Higai, Hiroshima (JP); Takayuki Futatsuka, Hiroshima (JP); Yoshikiyo Tamai, Chiba (JP); Takaaki Hira, Chiba (JP); Yuji Yamasaki, Hiroshima (JP)

(73) Assignee: JFE Steel Corporation (JP)

( * ) Notice: Subject to any disclaimer, the term of this patent is extended or adjusted under 35 U.S.C. 154(b) by 363 days.

(21) Appl. No.: 13/391,850

(22) PCT Filed: Sep. 15, 2010

(86) PCT No.: PCT/JP2010/066470
§ 371 (c)(1),
(2), (4) Date: May 3, 2012

(87) PCT Pub. No.: WO2011/034203
PCT Pub. Date: Mar. 24, 2011

(65) Prior Publication Data

US 2012/0204993 A1 Aug. 16, 2012

(30) Foreign Application Priority Data

Sep. 16, 2009 (JP) ..... 2009-213984

(51) Int. Cl.

| | |
|---|---|
| ***B21D 21/00*** | (2006.01) |
| ***B21D 47/01*** | (2006.01) |
| ***B21C 37/08*** | (2006.01) |
| ***B21D 11/20*** | (2006.01) |
| ***B21D 47/04*** | (2006.01) |
| ***B21D 51/06*** | (2006.01) |

(52) U.S. Cl.
CPC ..... *B21D 47/01* (2013.01); *B21C 37/0803* (2013.01); *B21D 11/20* (2013.01); *B21D 47/04* (2013.01); *B21D 51/06* (2013.01)

(58) Field of Classification Search
CPC ..... B21D 51/06; B21D 47/01; B21D 47/04; B21D 11/20; B21C 37/0803
USPC ..... 29/890.053; 72/368, 51, 367.1, 370.26
See application file for complete search history.

(56) References Cited

U.S. PATENT DOCUMENTS

2010/0133724 A1* 6/2010 Flehmig et al. ..... 264/294

FOREIGN PATENT DOCUMENTS

| | | |
|---|---|---|
| AU | 63924 73 | 6/1975 |
| DE | 101 01 927 | 7/2002 |

(Continued)

OTHER PUBLICATIONS

Supplementary European Search Report dated Oct. 27, 2014 from corresponding European Patent Application No. 10 81 7315.

*Primary Examiner* — David Bryant
*Assistant Examiner* — Ruth G Hidalgo-Hernandez
(74) *Attorney, Agent, or Firm* — DLA Piper LLP (US)

(57) ABSTRACT

A method for manufacturing includes a polygonal shape closed structure part with a bent shape in the longitudinal direction only by press forming. The method uses two metal plates for manufacturing a curvilineal closed structure part and includes a press forming process of forming straight or bent folding lines in the longitudinal direction of the two metal plates at positions corresponding to a polygonal bent shape with a flange formed at least at one of the ends of the width direction of each plate, a process of forming a closed structure by laying the two metal plates to overlap each other flange to flange and end to end for ends without flanges and by welding the portions laid to overlap each other in the longitudinal direction of the metal plates, and a process of forming a polygonal shape closed structure having a bent shape in the longitudinal direction by holding both ends of the closed structure and by compressing it toward its central axis.

3 Claims, 7 Drawing Sheets

(56) References Cited

FOREIGN PATENT DOCUMENTS

| | | | |
|---|---|---|---|
| FR | 531 221 | | 1/1922 |
| JP | 47-15280 | A | 8/1972 |
| JP | 2000-263169 | A | 9/2000 |
| JP | 2003-311329 | A | 11/2003 |
| JP | 2005-313203 | A | 11/2005 |
| JP | 2005313203 | A | * 11/2005 |
| JP | 2008-119723 | A | 5/2008 |
| JP | 2009-202233 | A | 9/2009 |
| WO | 02/060614 | | 8/2002 |

* cited by examiner

FIRST PROCESS PREFORMING

SECOND PROCESS WELDING OF FLANGES

THIRD PROCESS COMPRESSION BENDING FORMING

CURVILINEAL CLOSED STRUCTURE PARTS AND METHOD FOR MANUFACTURING THE SAME

RELATED APPLICATIONS

This is a §371 of International Application No. PCT/JP2010/066470, with an international filing date of Sep. 15, 2010, which is based on Japanese Patent Application No. 2009-213984, filed Sep. 16, 2009, the subject matter of which is incorporated by reference.

TECHNICAL FIELD

This disclosure relates to curvilineal closed parts and methods for manufacturing the same.

BACKGROUND

In general, it is known that two parts are joined together after being formed separately to obtain a closed structure part in the fields of automobiles and consumer electrical appliances. Hydroforming and roll forming are known methods for manufacturing curvilineal closed structure parts with flanges of minimized areas.

All of the peripheral portions of metal plates must be welded before the part is being filled with working fluid in existing hydroforming methods, but Japanese Unexamined Patent Application Publication Nos. 2008-119723, 2000-263169 and 2003-311329 disclose the following methods.

JP '723 discloses a hydroforming apparatus, a hydroforming method, and a product manufactured by the apparatus and method, which provide high productivity by ensuring good sealing in bulge forming of two or more metal plates laid to overlap each other without all of their peripheral portions being welded, and by deep-drawing multiple parts at the same time.

JP '169 discloses a method for manufacturing a closed section bent elongated member, including a multistage roll forming process in which strips are formed into a nearly closed structure, a crimping forming process in which the butting sections of the strips are joined together to make a closed section elongated member, and a bending process in which the elongated member is bent in the moving direction of the strips.

JP '329 discloses a technique for obtaining a product having a twisted portion in closed section out of one piece of material by press forming, and for manufacturing a high-quality lightweight and highly rigid pressed product having a twisted cross section at a low cost.

JP '723 discloses a hydroforming technique in which metal plates can be formed without the occurrence of leaking of working fluid by arranging sliding seals on plate holding surfaces to be brought into contact with one or both of the metal plates and non-sliding seals on the plate holding surface to be brought into contact with the other of the metal plates, whereas in existing hydroforming methods all of the peripheral portions of the metal plates must be welded before the part is filled with working fluid. A welding process before hydroforming can be omitted and the time taken to extract the working fluid can be reduced by using this method. The fact remains, however, that this method still uses hydroforming and the equipment cost is very high. In addition, welding is necessary to complete assembly of a product, which brings about the problem of poor surface accuracy.

JP '169 discloses a roll forming technique in which a closed section bent elongated member is formed by roll forming and crimping joints are formed on the surfaces in the longitudinal direction to omit welding of the butting sections. The cost of this technique may be lower than existing roll forming techniques due to continuous welding for forming a closed section being omitted, but it is difficult to reduce the cost of equipment, because many dies for roll forming are indispensable.

JP '329 discloses a press forming method. First, flanges are formed on the both sides of a blank which is preformed in this method. Then, the preformed part is pressed into a die which is narrower and closer to the final shape than the preformed part. Finally, the preformed part is pressed into a die which has a twisted portion in the longitudinal direction. In this case, a pressed part with a twisted portion having straight vertical walls can be formed, but, if a pressed part has curved vertical walls, a large rolling deformation is generated in the flanges formed by the preforming, which brings about a problem that it is difficult to match the butting sections to each other.

As mentioned above, hydroforming and roll forming are known methods for manufacturing closed structure parts, but those methods are disadvantageous compared to press forming in terms of costs of equipment and production, and press forming can be used only for limited cross sectional shapes.

It could therefore be helpful to provide a method for manufacturing polygonal shape closed structure parts with a bent shape in the longitudinal direction by only using press forming to reduce production cost.

SUMMARY

We thus provide a method for manufacturing a curvilineal closed structure part using two metal plates by performing compression bending after preforming and welding to reduce the number of press forming processes and improve accuracy of the part.

A first example is a method for manufacturing a curvilineal closed structure part using two metal plates. The method includes a press forming process of forming straight or bent folding lines in the longitudinal direction of the metal plates at positions corresponding to a polygonal bent shape and forming a flange at least at one of the ends in the width direction of each plate; a process of forming a closed structure by laying the two plates to overlap each other flange to flange, and end to end for ends without flanges and by welding the portions laid to overlap each other in the longitudinal direction of the plates; and a process of forming a polygonal shape closed structure with a bent shape in the longitudinal direction with the folding lines formed in the press forming process being used as origins of vertices of the polygonal shape, by holding the both ends of the closed structure with holding units, and by compressing the closed structure in the direction toward the central axis of the closed structure.

A second example is the method according to the first example, further including a process for trimming the flange after the press forming process.

A third example is a curvilineal closed structure part manufactured by the method according to the first or the second example.

A curvilineal closed structure part can thus be manufactured at a lower cost than by existing methods such as hydroforming and roll forming. Furthermore, a curvilineal shape is formed at a low cost, flanges are minimized to achieve reduced weight, and welded portions are placed closer to the main portion to improve rigidity including torsional rigidity. Moreover, it is easy to manufacture parts by using ultra-high strength steel plates, because a predetermined shape can be obtained mainly by bending forming.

BRIEF DESCRIPTION OF THE DRAWINGS

FIG. 2(*b*) illustrates an example of a manufacturing method.

FIG. 2(*c*) illustrates an example of a manufacturing method.

REFERENCE SIGNS LIST

1 cross section of closed structure part
2 cross section of closed structure part
α bending line in performing
β bending line in performing
A preformed part
B preformed part

DETAILED DESCRIPTION

A manufacturing method will be described below with reference to the drawings.

Figure 1:
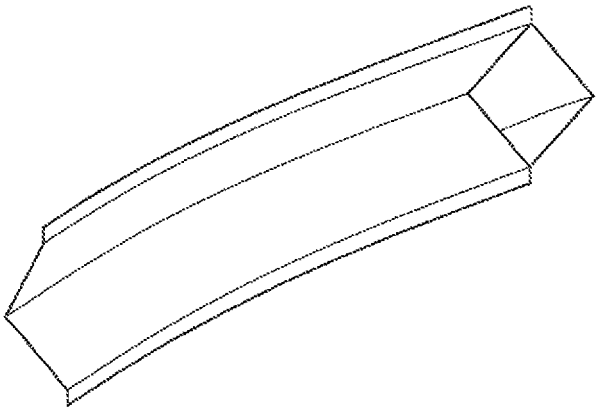
FIG. 1 illustrates an example of a curvilineal closed structure part.

FIG. 1 illustrates the appearance of a curvilineal closed structure part. The part has a tetragonal cross section, a bent shape in the longitudinal direction, and flanges at the opposing corners of the cross section. The length of each side of the tetragonal cross section is 30 mm. The length in the longitudinal direction is 300 mm. The curvature radius of the bent shape is 1000 mm. The width of the flange is 5 mm.

Figure 2A:
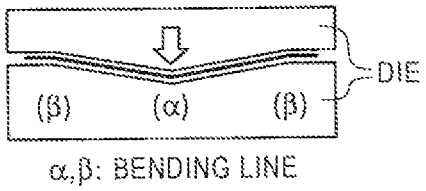
FIG. 2(*a*) illustrates an example of a manufacturing method.

FIGS. 2(*a*), 2(*b*), and 2(*c*) illustrate a method for manufacturing a curvilineal closed structure part.

FIG. 2(*a*) illustrates a preforming process as a first process of the method for manufacturing a tetragonal curvilineal closed structure part. Blanks A and B, which form the shape of a tetragon bisected along its diagonal, are made of two metal plates in the process. The cross section is not necessarily a tetragon, and although in this example, a tetragon is explained, the cross section may be another polygonal shape such as a pentagon or a hexagon.

The preforming process gives the metal plates bent portions in advance at positions corresponding to those which are to be vertices of the tetragon cross section.

A bending line α, which is formed by the punch bottom of a preforming die, is formed with a predetermined curvature so that the part is formed into a bent shape in the final compression bending forming process which is the third process example.

In addition, portions (flanges at ends of the plate in the width direction) that are to become welding surfaces are also formed so that bending lines β are bent with a predetermined curvature. The bending line α and bending lines β have the same curvature and center of curvature in FIG. 2(*a*), but it is also possible for the part to be simultaneously given a bent and twisted shape by varying curvature and center of curvature of the bending line α and bending line β respectively. The flanges are formed at both ends in the width direction of the metal plate in FIG. 2(*a*), but the flange may be formed at least at one of the ends.

Figure 2B:
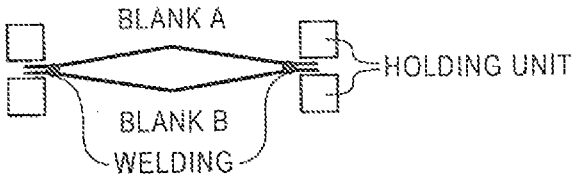

FIG. 2(*b*) illustrates the second process example in which the two metal plates preformed in the first process are laid to overlap each other and welded into a single body. The two metal plates preformed in the first process are laid to overlap each other with their bulging surfaces facing outward, held with holding units on the both ends, and welded along the vicinities of bending lines β on both ends. The width of the flange is 5 mm in FIG. 2(B).

The both ends in the width direction of the metal plate, moreover, may be trimmed before welding, leaving enough width so that the flanges can be held by holding units, which enables the weight of parts to be reduced by minimizing the sizes of the flanges.

FIG. 2B illustrates the case in which the flanges are formed at both ends in the width direction of the metal plate, but, in the case in which a flange is formed only at one end of the metal plate, an end without a flange can be also held with certain holding units (not illustrated), and the vicinity of the end can be subjected to welding. The method for the welding is not necessarily limited to any specified method, and typical methods, such as spot welding, laser welding, arc welding, TIG welding, and seam welding, can be used. The entirety or part of peripheral portions of the metal plates can be continuously welded in the longitudinal direction of the metal plates.

FIG. 2(*c*) illustrates the final process example in which the shape of the part is determined by compression bending. Each flange at both ends of the preformed part, after being welded, is held respectively by a holding unit having a shape that follows that of the welding line, and is compressed in the direction towards central axis of the part, which means compression performed by shortening the distance between the holding units. As compression progresses, the angles of the cross section at the welded portions of the part become larger, and the angles of the cross section around the bending lines α become smaller at the same time. The compression amount is adjusted for the angles of the cross section to become the specified values after unloading.

Figure 2C:
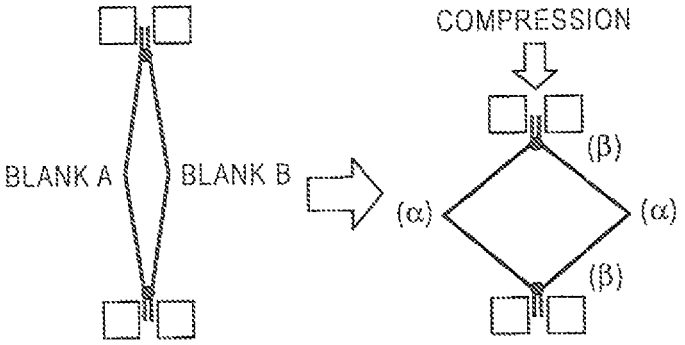

FIG. 2C illustrates the case in which the flanges are formed at both ends in the width direction of the metal plate, but, in the case with a flange only at one end of the metal plate, the end without a flange can be also held by certain holding units (not illustrated), and formed by compression forming as in the case with flanges at both ends.

As for the metal plate to be applied to manufacture the closed structure part, any kind of metal plate, such as steel and non-ferrous materials, can be used. Among steel, normal steel, such as a hot rolled steel plate, a cold rolled steel plate, a coated steel plate which is, for example, galvanized or aluminized, and any kind of steel, from mild steel to ultra-high strength steel, can be used.

EXAMPLES

FIGS. 3 to 7 illustrate Examples in which tetragonal curvilineal closed structure parts were formed into various shapes in the preforming process (first process example) and welded by laser welding along the bending lines β, and formability and weldability thereof were evaluated after compression bending. A TS 980 MPa grade galvannealed steel plate (GA) of 1.2 mm in thickness was used as the material. The zinc coating weight per single side of the blank was 45 g/m$^2$. The output of the laser welder was 3.8 KA. Welding speed was 2.5 m/min.

Blanks A and B, which form the shape of a tetragon bisected by its diagonal, were formed in the preforming process. Examples of the blank A and blank B are illustrated in FIGS. 2(*b*), 2(*c*), and 3 to 7. FIG. 2(*c*) illustrates a cross section after compression forming. The shapes of cross section 1 and cross section 2 viewed in the longitudinal direction are illustrated as overlapping each other in FIGS. 3 to 7. Bending lines α and β correspond to the vertices of the polygonal section, and are base lines for bending forming. The bending line β is also the welding base line used when the blank A and blank B are laid to overlap each other and then welded.

No. 1

Example 1

Figure 3:
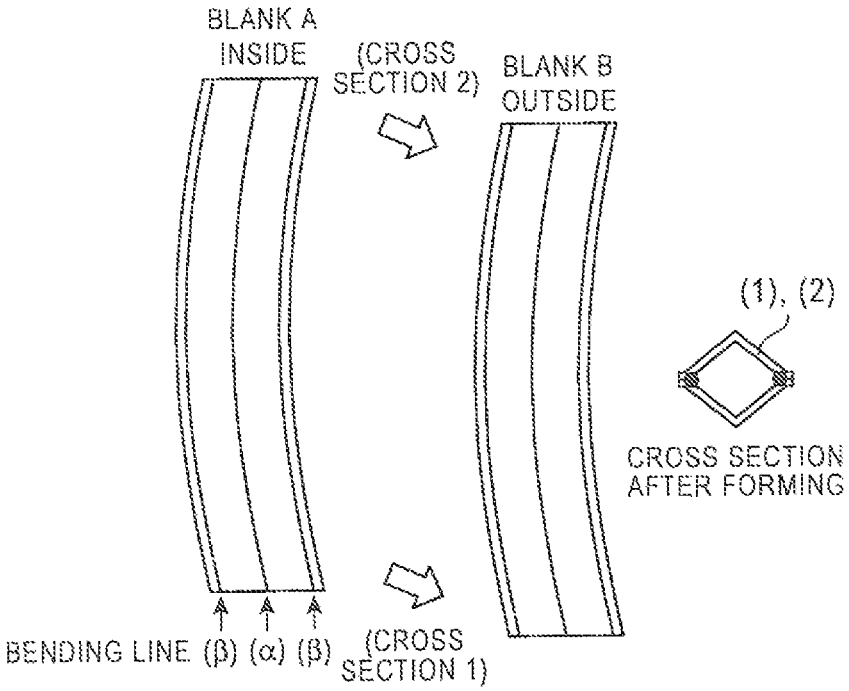
FIG. 3 illustrates a preformed shape and a cross section after forming of Example 1.

FIG. 3 illustrates a preformed shape and a cross section after forming of Example 1. The length of each side of the tetragonal cross section was 30 mm. The length in the longitudinal direction was 300 mm. The curvature radius of the bent shape was 1000 mm. The width of the flange was 5 mm without trimming of the flange after preforming.

Bending lines α and β were parallel to each other, and all the bending lines were at the same relative positions on both the blank A and blank B.

No. 2

Example 2

Figure 4:
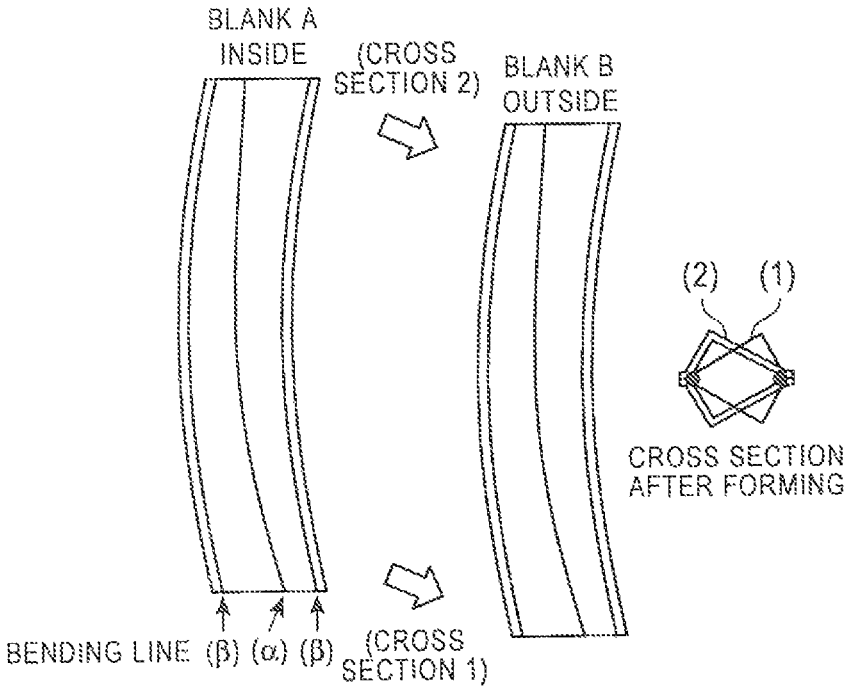
FIG. 4 illustrates a preformed shape and a cross section after forming of Example 2.

FIG. 4 illustrates a preformed shape and a cross section after forming of Example 2. The length of the long sides of the tetragonal cross section, which was virtually a kite shape, was 40 mm, and the short sides 20 mm. The length in the longitudinal direction was 300 mm. The curvature radius of the bent shape was 1000 mm. The width of the flange was 3 mm without trimming of the flange after preforming.

Bending lines α and β were of the same curvature, but were not parallel to each other, and all the bending lines were at the same relative positions on both the blank A and blank B.

No. 3

Example 3

Figure 5:
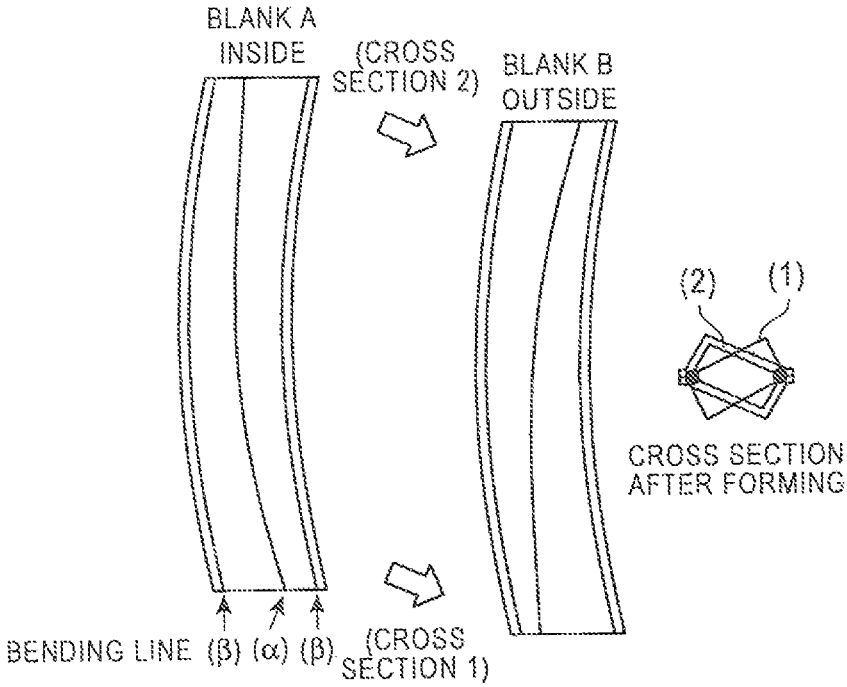
FIG. 5 illustrates a preformed shape and a cross section after forming of Example 3.

FIG. 5 illustrates a preformed shape and a cross section after forming of Example 3. The length of the long sides of the rectangular of the cross section was 40 mm, and the short sides 20 mm. The length in the longitudinal direction was 300 mm. The curvature radius of the bent shape was 1000 mm. The width of the flange was 5 mm without trimming of the flange after preforming.

Bending lines α and β were of the same curvature, but were not parallel to each other, and the bending lines α on the blank A and blank B were tilted in opposite directions to each other, which resulted in the left and right sides of the shape of cross section 1 being reversed in cross section 2.

No. 4

Example 4

Figure 6:
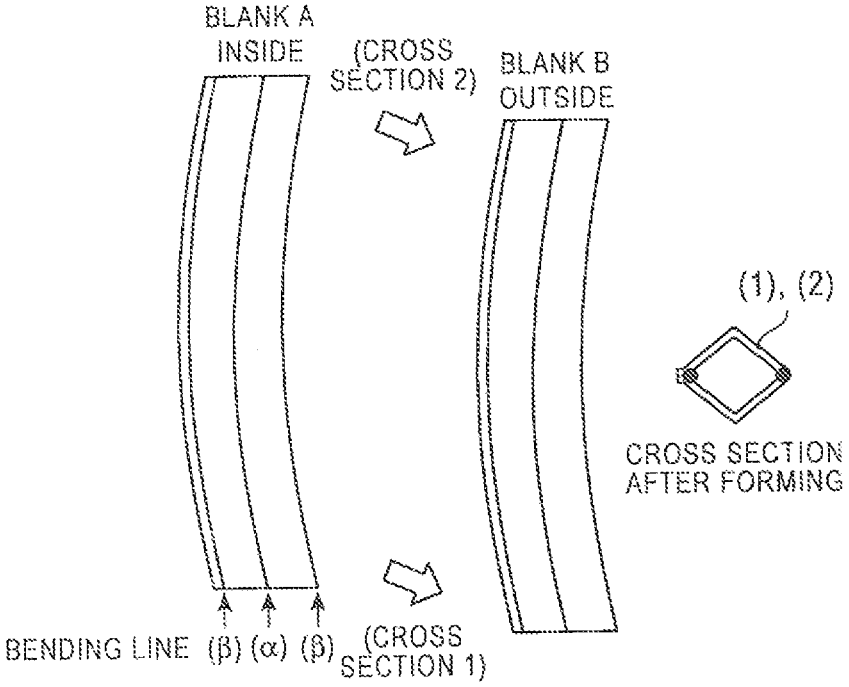
FIG. 6 illustrates a preformed shape and a cross section after forming of Example 4.

FIG. 6 illustrates a preformed shape and a cross section after forming of Example 4. The length of each side of the tetragonal cross section was 30 mm. The length in the longitudinal direction was 300 mm. The curvature radius of the bent shape was 1000 mm. The width of the flange after preforming was 5 mm after being trimmed.

Bending lines α and β were parallel to each other and all the bending lines were at the same relative positions on both the blank A and blank B, as in the case of Example 1, but there was not a flange along one of the two bending lines β. The blank A and blank B, therefore, were joined along the entire length of the side without a flange by arc welding, after being laid to overlap each other.

No. 5

Comparative Example 1

Figure 7:
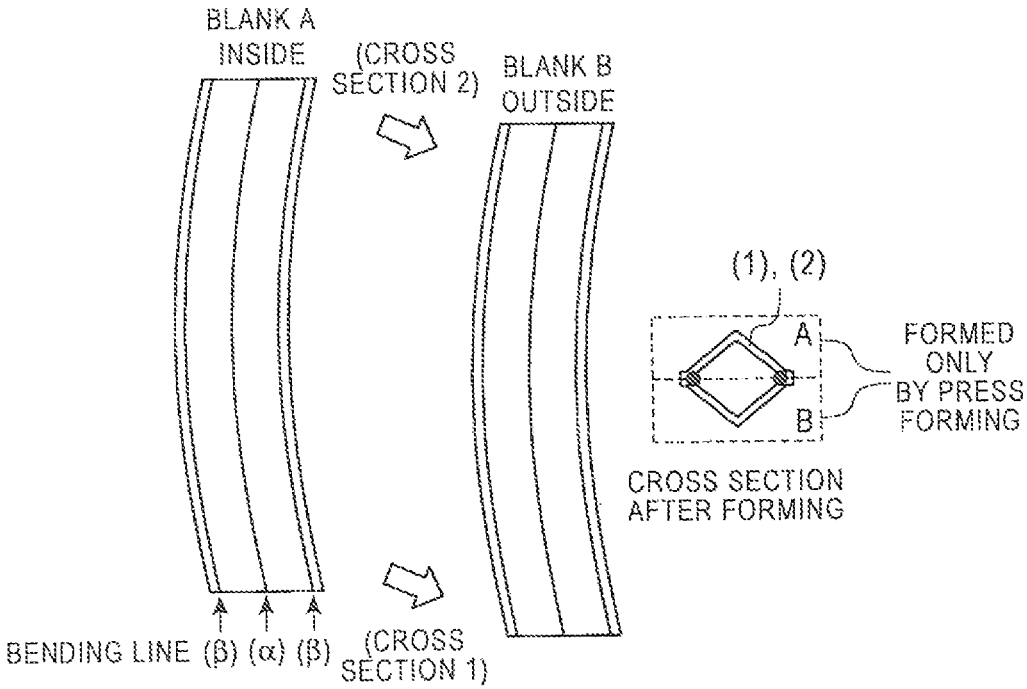
FIG. 7 illustrates a preformed shape and a cross section after forming of Comparative Example 1.

FIG. 7 illustrates a preformed shape and a cross section after forming of Comparative Example 1. The length of each side of the tetragonal cross section was 30 mm. The length in the longitudinal direction was 300 mm. The curvature radius of the bent shape was 1000 mm.

Blanks A and B were formed into the final shape by press forming, and then joined together at the flanges by continuous welding to obtain a tetragonal closed section.

Evaluation Results

Formability and weldability of each of the tetragonal curvilineal closed structure parts formed in No. 1 to No. 5 described above were evaluated.

Table 1 describes the evaluation results. The evaluation results are indicated as follows: ○ indicates "was able to be formed" or "was able to be welded," and x indicates "was not able to be formed" or "was not able to be welded."

TABLE 1

| No. | Flange Position | Formability | Weldability | Note |
|---|---|---|---|---|
| 1 | both sides | ○ | ○ | Example 1 |
| 2 | both sides | ○ | ○ | Example 2 |
| 3 | both sides | ○ | ○ | Example 3 |
| 4 | one side | ○ | ○ | Example 4 |
| 5 | both sides | X (wrinkle, twist) | X | Comparative Example 1 |

Notation:
○: "was able to be formed" or "was able to be welded"
X: "was not able to be formed" or "was not able to be welded"

Examples 1 to 4 were all able to be formed and welded, and no problems such as cracks or fractures occurred in the welded portions after forming.

In contrast, twisting, wrinkling and spring back occurred and dimensional accuracy was very poor in the case of Comparative Example 1. The matching accuracy, moreover, of the flanges after press forming was so poor that there were gaps at the overlapping portions, which resulted in non-welded portions, and laser welding was impossible. Therefore, the durability of Comparative Example 1 was greatly reduced for the part to be used as a part such as a part for an automobile.

Tetragonal cross section is formed only by bending forming which enables thin high-strength steel plates to be used. For example, such a part can be applied to an automobile part, for example, a reinforcement member such as a front pillar, a roof rail and a door impact beam, because the flange width can be made as small as from 3 to 5 mm.

The invention claimed is:

1. A method of manufacturing a curvilineal closed structure part using two metal plates, comprising:

a press forming process of forming straight or bent folding lines in a longitudinal direction of the metal plates at positions corresponding to a polygonal bent shape, and forming a flange at least at one of ends of the width direction of each metal plate;

a process of forming a closed structure by laying the two metal plates to overlap each other flange to flange and end to end for ends without flanges and by welding portions arranged to overlap each other in the longitudinal direction of the metal plates; and a process of forming a polygonal shape closed structure with a bent shape in the longitudinal direction with the folding lines formed in the press forming process being used as origins of vertices of the polygonal shape, by holding both ends of the closed structure with holding units, and by compressing the closed structure in the direction toward the central axis of the closed structure, and by only using press forming.

2. The method according to claim 1, further comprising a process of trimming the flange after the press forming process.

3. A method of manufacturing a curvilineal closed structure part using two metal plates, comprising:

a press forming process of forming bent folding lines in a longitudinal direction of the metal plates at positions corresponding to a polygonal bent shape, and forming a flange at least at one of ends of the width direction of each metal plate;

a process of forming a closed structure by laying the two metal plates to overlap each other flange to flange and end to end for ends without flanges and by welding portions arranged to overlap each other in the longitudinal direction of the metal plates; and a process of forming a polygonal shape closed structure with a bent shape in the longitudinal direction with the folding lines formed in the press forming process being used as origins of vertices of the polygonal shape, by holding both ends of the closed structure with holding units, and by compressing the closed structure in the direction toward the central axis of the closed structure, and by only using press forming.

* * * * *